United States Patent [19]

Leigh et al.

[11] Patent Number: 4,706,802

[45] Date of Patent: Nov. 17, 1987

[54] DEVICE FOR CONDITIONING FABRICS IN THE TUMBLE-DRYER

[75] Inventors: Arthur G. Leigh, Wirral; John R. Martin, Birkenhead, both of England

[73] Assignee: Lever Brothers Company, New York, N.Y.

[21] Appl. No.: 865,219

[22] Filed: May 20, 1986

[30] Foreign Application Priority Data

May 29, 1985 [GB] United Kingdom ..... 8513480

[51] Int. Cl.[4] ..... F26B 7/00

[52] U.S. Cl. ..... 206/0.5; 34/12; 252/8.8

[58] Field of Search ..... 206/0.5; 252/90, 8.8; 34/12

[56] References Cited

U.S. PATENT DOCUMENTS

| | | | |
|---|---|---|---|
| 2,920,417 | 1/1960 | Wertheimer | 206/0.5 |
| 2,967,776 | 1/1961 | Utley | 206/0.5 |
| 3,792,979 | 2/1974 | Clinton | 206/0.5 |
| 4,208,012 | 6/1980 | Dutcher | 206/0.5 |
| 4,231,476 | 11/1980 | Compton et al. . | |
| 4,345,512 | 8/1982 | Moore | 206/0.5 |
| 4,532,719 | 8/1985 | Davies et al. . | |
| 4,532,722 | 8/1985 | Sax | 206/0.5 |
| 4,588,080 | 5/1986 | Ginn | 206/0.5 |

FOREIGN PATENT DOCUMENTS

| | | |
|---|---|---|
| 52813/73 | 9/1974 | Australia . |
| 2519941 | 7/1983 | France . |
| 2122657 | 1/1984 | United Kingdom . |

*Primary Examiner*—Joseph Man-Fu Moy

*Attorney, Agent, or Firm*—Milton L. Honig; James J. Farrell

[57] ABSTRACT

A device for conditioning fabrics in a laundry dryer comprises a fabric conditioning agent in powder form in a container having a plurality of apertures through which the powdered fabric conditioning agent can pass, the container being provided with at least one outwardly projecting region which is effective to prevent or reduce direct contact between the said apertures and the fabrics, the projecting region also enabling the device to be stacked together with a second identical device in such a manner that the second device will close the said apertures. The device may be of general frustoconical configuration, resembling a disposable drinking cup with a perforated false bottom. To prevent misuse of the device as a cup, the upper part of the side wall may advantageously be apertured.

5 Claims, 6 Drawing Figures

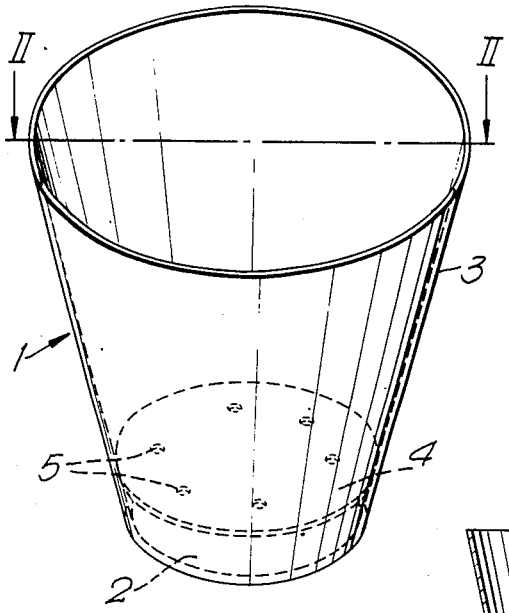
Fig. 1.
Fig. 2.
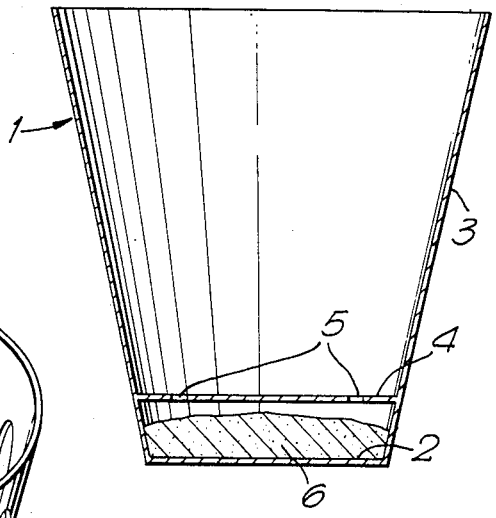
Fig. 3.
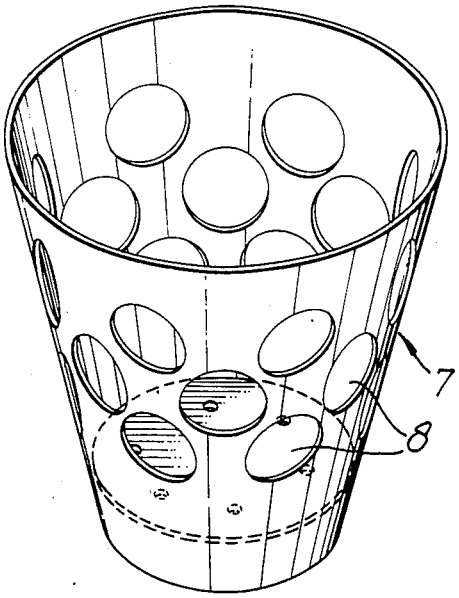

DEVICE FOR CONDITIONING FABRICS IN THE TUMBLE-DRYER

TECHNICAL FIELD

The present invention relates to a device for conditioning fabrics in the tumble-dryer. The device of the invention is placed together with the damp fabrics in the dryer and acts by scattering or sprinkling a fabric conditioning composition in powder form onto the fabrics during the dryer cycle.

BACKGROUND ART

AU No. 52 813/73 (Economics Laboratory) discloses a method of conditioning fabrics in the dryer in which a particulate fabric conditioning agent is placed within a salt-shaker type dispenser which is concurrently tumbled with the fabrics to be dried, thereby distributing the particulate fabric conditioning agent over the surface of the fabrics.

GB No. 2 122 657A (Unilever) disclose conditioning fabrics by this general method. The particulate fabric conditioner is contained within a first container—a flexible sachet—having pores or perforations large enough to be permeable to the conditioner, and the sachet is in turn contained within an outer, form-retaining container with larger holes. The outer container is shaped so as to move freely among the fabrics. This device has the major advantage that the pores or perforations of the inner sachet cannot become clogged with damp powder as a result of direct contact with the damp fabrics: such direct contact is prevented by the intervention of the outer container. The device has however been found to be somewhat complex in operation: the inner sachet must be protected by a covering of some sort to prevent premature escape of powder, and then, immediately before use, the covering must be stripped off and the sachet inserted into the outer container.

DISCLOSURE OF THE INVENTION

The present invention is concerned with an improved disposable device in which the problems of minimising direct contact between damp fabrics and dispensing holes, and of keeping those holes closed until immediately before use, are simultaneously solved in a simple and elegant manner.

The present invention provides a device for conditioning fabrics in a laundry dryer, which device comprises a fabric conditioning agent in powder form in a container having a plurality of apertures through which the powdered fabric conditioning agent can pass, the container being provided with at least one outwardly projecting region which is effective to prevent or reduce direct contact between the said apertures and the fabrics, the projecting region also enabling the device to be stacked together with a second identical device in such a manner that the second device will close the said apertures.

Conveniently the device of the invention may be of generally tapered configuration is suitable, with a base and an adjacent peripheral wall extending upwardly from the base, the base and peripheral wall being free of apertures, and an upper surface, larger in area than the base, being apertured, that is to say, porous or provided with a suitable number of suitably sized perforations. The peripheral wall extends upwardly beyond the apertured upper surface to an extent sufficient to confer stackability, that is to say, sufficient to allow the base of another, identical, device to nest stably and firmly against the apertured upper surface of the first device, thus closing off its perforations or pores. The upwardly extending peripheral wall, as well as conferring stackability, is effective greatly to reduce the chance of damp fabrics coming into direct contact with the apertured surface of the device. We have found particularly successful results when the ratio of height of the peripheral wall above the apertured surface to the largest dimension of the apertured surface is from 0.6:1 to 1.46:1. In particular, a device of generally frustoconical configuration is preferred, having a circular base, a curved peripheral wall and a circular upper surface.

In this preferred embodiment, the device of the invention thus resembles a disposable drinking cup with a false bottom. Because of this, there is a danger that it could be misused, especially by children. Accordingly, it is preferred that the curved peripheral wall be punctured or perforated to such an extent that the device will not hold liquid or cannot otherwise be used as a drinking cup. It has been found that the peripheral wall can be provided with relatively large holes without reducing the efficiency of the device: indeed, the delivery of powder in the early stages of the dryer cycle appears to be accelerated.

Devices of the invention can thus be provided in stacks from which one at a time may be detached as required. Each device in the stack is effective to close the following one, and if desired the uppermost device in the stack may be a dummy, without powder and without the apertured delivery surface, the purpose of which is purely to close off the first working device of the stack. This may be replaced as successive devices of the stack are used, and may conveniently be distinguished from the working devices by being differently coloured. Alternatively the first (working) device of the stack may be provided with a plug or the like which closes its apertures, and this may be replaced as the devices are used up. Provision of a dummy device or plug is not, however, absolutely essential when the configuration of the device is such that stacking is vertical, the uppermost device being removed first from the stack, and the apertured delivery surface is substantially horizontal: this is clearly the case with the preferred frustoconical embodiment described above. Unless the fabric conditioning agent is especially sensitive to atmospheric moisture, gravity may be sufficient to prevent premature escape of the powder from the second and subsequent devices of the stack as they are successively exposed. The first (uppermost) device of the stack will of course normally be protected initially by packaging of some sort.

The device of the invention may be constructed of material that is substantially form-retaining, so that it is not significantly deformed as it moves among the fabrics, but it need not be completely rigid: it may be to some extent energy-absorbing, and thus sound-absorbing, so that the noise the device makes on impact with the dryer drum is not excessive. The material should ideally be robust enough to survive the repeated impacts and pressure that the device will suffer in the dryer; be water-resistant; and be stable at the sort of temperatures (possibly up to 100° C.) encountered in a tumble-dryer. Suitable materials include thermoplastic and thermosetting resins, wood, resin-bonded or foil-coated cardboard, natural and synthetic rubbers, and lightweight metals such as aluminium. Thermoplastic materials of sufficiently high softening point (preferably above 130° C.) and robustness offer manufacturing advantages in that suitable shapes can readily be made by moulding techniques such as injection, extrusion and blow-moulding. Preferred materials include polypropylene, especially in foamed form.

Permeability to the powdered fabric conditioning agent may be achieved by providing a suitable number of suitably sized perforations. Alternatively, part of the outer surface of the device may consist of porous material, for example, a mesh of some sort.

The dimensions of the device of the invention should be chosen so as to accommodate a dose of powdered fabric conditioning agent suitable for a single load of fabrics. The size of such a dose will of course depend on the nature of the fabric conditioning agent. The term "fabric conditioning agent" is used here in the broadest sense to encompass any material conferring any benefit, for example, softness, reduced static charge, perfume, drape, crease resistance, ease of ironing, or improved bleaching, to fabrics in a tumble-dryer.

Of particular interest are materials that simultaneously increase softness and reduce static charge. Examples of such materials include cationic fabric conditioners such as quaternary ammonium and imidazolinium salts. Especially preferred on cost and safety grounds, however, are the soap blends disclosed in GB No. 2 136 028A (Unilever) and the mixtures of these soap blends with alcohol ethoxylates which comprise:

(i) at least 80% by weight of a blend of soaps of $C_8$ to $C_{22}$ saturated or unsaturated fatty acids, said soap blend containing at least 5% by weight of $C_{12}$ soap, at least 5% by weight of $C_{14}$ soap, at least 12% by weight of $C_{16}$ soap and at least 20% by weight of $C_{18}$ soap, said soap blend being in the form of a powder free of any protective coating, and (ii) from 5 to 20% by weight of at least one $C_{16}$–$C_{22}$ aliphatic alcohol ethoxylated with an average of from 5 to 30 moles of ethylene oxide.

These compositions preferably contain from 5 to 10% by weight of the ethoxylated alcohol, which is preferably an ethoxylate of tallow alcohol, the 25EO ethoxylate being especially preferred for ease of processing because it is available as a free-flowing spray-cooled powder.

The soap blend is conveniently a commercial blend of tallow and coconut soaps, as used in toilet soap bars and fabric washing soap flakes.

The powdered fabric conditioning agent may advantageously contain a perfume. This is preferably fabric-substantive.

The dose of fabric conditioning agent contained in a device of the invention suitable for use in a domestic UK or European tumble-dryer may suitably range from 1.5 to 12 g, preferably from 2.5 to 10 g and optimally from 2.5 to 7 g.

The particle size of the fabric conditioning agent should be sufficiently low to ensure uniformity of delivery, but sufficiently high to avoid safety objections of excessive respirability. A preferred range is 20 to 1000 μm, more preferably 70 to 500 μm, and especially 90 to 250 μm.

The size of the dispensing apertures (pores or perforations) should be tailored to the particle size of the powder, and the number and size is also determined by the desired speed of delivery. For a powder of particle size 90 to 250 μm, it has been found that satisfactory delivery can be achieved under a range of tumble-dryer conditions through six or more circular perforations of 2 mm diameter. Larger holes could presumably be used, but if they were too large premature leakage of powder could become a problem.

DESCRIPTION OF THE FIGURES IN THE DRAWINGS

Some devices according to the invention will now be described in further detail, by way of example only, with reference to the accompanying drawings, in which:

FIG. 1 is a schematic perspective view of a first device according to the invention;

FIG. 2 is a vertical section along the line II—II of FIG. 1;

FIG. 3 is a schematic perspective view of a second device according to the invention;

Figure 5:
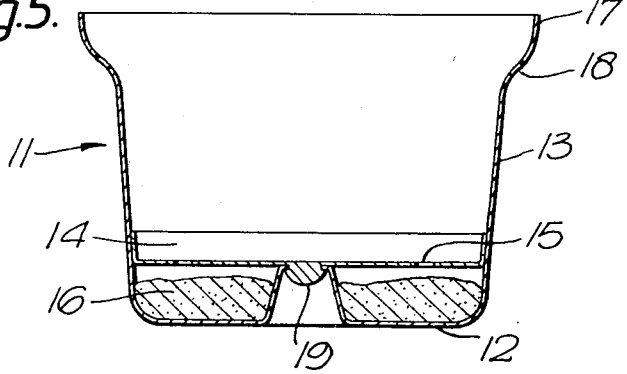
FIG. 5 is a vertical section through a third device according to the invention.

Referring now to FIGS. 1 and 2 of the accompanying drawings, a cup-like generally frustoconical device 1 has a circular base 2 and a curved peripheral wall 3. Above the base 2 and parallel to it is a circular covering member 4 (the delivery surface) provided with six dispensing holes 5. Disposed between the base 2 and the delivery surface 4 is a powdered fabric conditioning agent 6 (not shown in FIG. 1 for the sake of clarity). The curved peripheral wall 3 extends upwardly beyond the delivery surface 4 so as to distance the delivery surface 4 from possible contact with fabrics in the tumble-dryer. Typically the dimensions of the device of FIG. 1 may be as follows: diameter of base 4.5 cm, diameter of delivery surface 5.0 cm; height of delivery surface above base 1.0 cm; total height 8.3 cm or 4.0 cm; ratio of peripheral wall height above delivery surface to diameter of delivery surface 1.46:1 or 0.6:1.

FIG. 3 shows a variant 7 of the device of FIGS. 1 and 2 in which the upwardly extending peripheral wall is provided with relatively large vent holes 8. These prevent potential misuse of the device as a cup and have also been found to accelerate the delivery of powder in the early stages of the dryer cycle.

Figure 4:
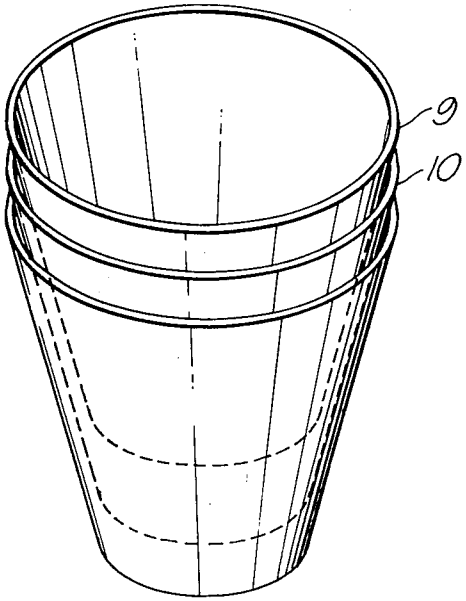
FIG. 4 represents a stack of devices according to FIGS. 1 and 2.

FIG. 4 shows how three devices in accordance with FIGS. 1 and 2 can be stacked so that the base of the uppermost device 9 nests against the delivery surface of the device 10 immediately below it, thus closing its dispensing holes.

Figure 6:
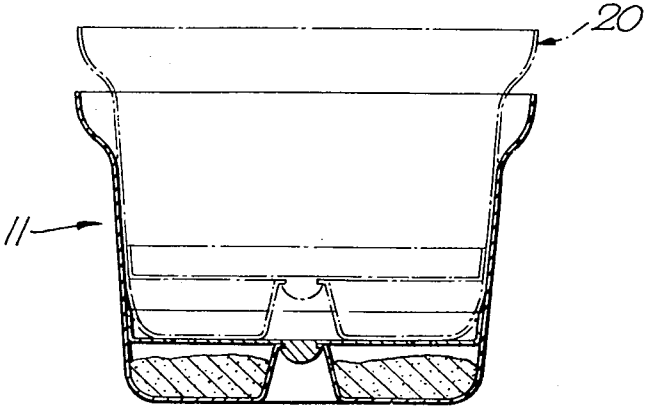
FIG. 6 is a vertical section through a stack of devices according to FIG. 5.

Referring now to FIG. 5 of the accompanying drawings, a cup-like generally frustoconical device 11 has a circular base 12 and a curved peripheral wall 13. Above the base 12 and parallel to it is a circular covering member 14, the upwardly directed surface of which represents the delivery surface and is provided with a number of dispensing holes 15 (for example six). The covering member 14 is held in position relative to the base 12 by means of a press-stud fastening 19, thereby defining an annular space between the base 12 and the covering member 14 in which space is provided for a powdered fabric conditioning agent 16. The curved peripheral wall extends upwardly beyond the covering member 14 so as to distance the delivery surface from possible contact with the fabrics in the tumble dryer. The upper most portion of the peripheral wall 13 is formed as a lip 17 which is provided with a number of apertures 18 (say four in number) extending through the peripheral wall 13. These apertures prevent the misuse of the device as a drinking cup. As an alternative the press stud fastening 19 can be arranged to be powder tight, but not liquid tight so as to achieve the same objective. FIG. 6 of the accompanying drawing shows how two devices of FIG. 5 are capable of being stacked together, the delivery surface of the lower device 11 being effectively closed off by the base of the upper device 20.

The invention is further illustrated by the following non-limiting Examples.

EXAMPLES

Clean loads of mixed articles (2.2 kg dry weight), comprising approximately half cotton and half synthetic fabrics (nylon, acrylic, polyester), were washed in a Miele (Trade Mark) 429 front-loading automatic washing machine using 100 g per load of Persil (Trade Mark) Automatic washing powder and without using a rinse conditioner. After rinsing and spinning, the loads were tumble-dried in a Creda Reversomat (Trade Mark) tumble-dryer. Included with each load was a device in accordance with the invention, as specified in more detail below, containing 6 g of conditioning powder.

The conditioning powder used consisted of 9 parts (5.4 g) of soap (82% tallow soap, 18% coconut soap) and 1 part (0.6 g) of ethoxylated (25EO) tallow alcohol. The particle size range was 90–250 μm. Two batches of powder differing in perfume level, referred to as Batches A and B, were used: Batch A contained 1.5% by weight of perfume, while Batch B contained 0.9% by weight of perfume. Batch B was a more freely flowing powder especially when used in the tumble-dryer at the high heat setting.

EXAMPLE 1

Conditioning powder of Batch A (6 g per device) was contained in dispensing devices as described above with reference to FIGS. 1 and 2 of the accompanying drawings, having a height of 4.0 cm. Each device was constructed wholly of polystyrene as used for disposable drinking cups, the delivery surface of each device being provided with one, three or six 2-mm perforations arranged symmetrically. The devices were included with loads of washed fabrics, as described above, in the tumble-dryer at both high and low heat settings, and the delivery of powder was monitored as a function of time and of the number of dispensing holes. The results are shown in Table 1.

TABLE 1

| Time | Delivery of powder (grams) | | | | | |
|---|---|---|---|---|---|---|
| | Low heat | | | High heat | | |
| (min) | 1 hole | 3 holes | 6 holes | 1 hole | 3 holes | 6 holes |
| 5 | 0.47 | 2.04 | 4.19 | 0.15 | 1.19 | 3.37 |
| 10 | 0.77 | 3.79 | 5.49 | 0.24 | 1.72 | 3.89 |
| 15 | 1.05 | 4.55 | 5.78 | 0.29 | 2.07 | 4.30 |
| 20 | 1.38 | 5.13 | 5.82 | 0.30 | 2.27 | 4.50 |
| 25 | 1.65 | 5.43 | 5.84 | 0.30 | 2.41 | 4.61 |
| 30 | 1.94 | 5.65 | 5.86 | 0.33 | 2.51 | 4.71 |
| 40 | 2.41 | 5.83 | 5.86 | 0.43 | 2.79 | 5.18 |
| 50 | 2.64 | 5.87 | 5.91 | 0.47 | 3.10 | 5.34 |
| 60 | 2.70 | 5.90 | 5.92 | 0.59 | 3.64 | 5.47 |
| 70 | 2.85 | 5.90 | 5.92 | — | — | — |
| 80 | 3.04 | 5.90 | 5.92 | — | — | — |
| 90 | 3.36 | 5.91 | 5.92 | — | — | — |

It will be seen that one hole was inadequate at both heat settings. At the low heat setting three holes delivered 5 of the 6 g of powder within 20 minutes, while with six holes delivery was virtually complete within this period: with only three holes, substantially complete delivery took about 40 minutes. At the high heat setting delivery was poor both from one hole and from three holes. It is apparent that for good delivery of this powder under all conditions at least six holes are required.

EXAMPLE 2

The procedure of Example 1 was repeated using a set of similar dispensing devices each having the greater overall height of 8.3 cm. This time devices having twenty dispensing holes were also tested. The results are shown in Table 2.

TABLE 2

| Time | Delivery of powder (grams) | | | | | | | |
|---|---|---|---|---|---|---|---|---|
| | Low heat | | | | High heat | | | |
| (min) | 1 hole | 3 holes | 6 holes | 20 holes | 1 hole | 3 holes | 6 holes | 20 holes |
| 5 | 0.28 | 1.24 | 2.86 | 4.76 | 0.34 | 0.91 | 2.14 | 3.82 |
| 10 | 0.52 | 1.99 | 4.21 | 5.20 | 0.64 | 1.43 | 2.65 | 4.11 |
| 15 | 0.97 | 2.67 | 4.66 | 5.32 | 0.75 | 1.70 | 2.81 | 4.29 |
| 20 | 1.35 | 3.33 | 5.23 | 5.39 | 0.83 | 1.82 | 2.89 | 4.52 |
| 25 | 1.64 | 3.70 | 5.63 | 5.44 | 0.91 | 1.92 | 2.97 | 4.75 |
| 30 | 1.92 | 4.03 | 5.66 | 5.54 | 0.92 | 2.07 | 3.15 | 5.05 |
| 40 | 2.32 | 4.43 | 5.72 | 5.61 | 1.11 | 2.35 | 3.56 | 5.36 |
| 50 | 2.40 | 4.61 | 5.80 | 5.62 | 1.18 | 2.53 | 3.62 | 5.52 |
| 60 | 2.61 | 5.00 | 5.81 | 5.72 | 1.28 | 2.63 | 3.69 | 5.68 |
| 70 | 2.82 | 5.17 | 5.89 | 5.74 | — | — | — | |
| 80 | 2.91 | 5.34 | 5.90 | 5.74 | — | — | — | |
| 90 | 3.38 | 5.66 | 5.91 | 5.75 | — | — | — | |

Comparison with Table 1 shows that at both heat settings delivery by three holes and by six holes was slower then with the shorter device of Example 1. Delivery with twenty holes was good at the low heat setting but not optimum at the high heat setting.

EXAMPLE 3

The procedure of Example 1 was repeated, using devices of 4.0 cm height and the slightly more freely flowing conditioning powder of Batch B. The results are shown in Table 3.

TABLE 3

| Time | Delivery of powder (grams) | | | | | |
|---|---|---|---|---|---|---|
| | Low heat | | | High heat | | |
| (min) | 1 hole | 3 holes | 6 holes | 1 hole | 3 holes | 6 holes |
| 5 | 0.84 | 3.26 | 5.23 | 0.71 | 3.80 | 4.23 |
| 10 | 1.93 | 4.78 | 5.85 | 1.37 | 4.73 | 5.03 |
| 15 | 2.67 | 5.30 | 5.92 | 1.73 | 5.15 | 5.42 |
| 20 | 3.17 | 5.64 | 5.92 | 1.89 | 5.54 | 5.62 |
| 25 | 3.52 | 5.76 | 5.93 | 2.03 | 5.80 | 5.77 |
| 30 | 3.68 | 5.83 | 5.97 | 2.30 | 5.86 | 5.83 |
| 40 | 3.99 | 5.83 | 5.97 | 2.63 | 5.91 | 5.90 |
| 50 | 4.22 | 5.87 | 5.97 | 2.81 | 5.93 | 5.90 |
| 60 | 4.41 | 5.88 | 5.97 | 3.09 | 5.93 | 5.90 |
| 70 | 4.55 | 5.88 | 5.97 | — | — | — |
| 80 | 4.64 | 5.90 | 5.97 | — | — | — |
| 90 | 4.89 | 5.90 | 5.97 | | | |

Comparison with Table 1 shows a considerably improved delivery of powder at both heat settings.

EXAMPLE 4

The procedure of Example 2, with the taller (8.3 cm) devices, was repeated using the powder of Batch B.

Devices with one, three, six, ten and twenty dispensing holes were used. The results are shown in Table 4.

TABLE 4a

| Time (min) | Delivery of powder (grams) Low heat 1 hole | 3 holes | 6 holes | 10 holes | 20 holes |
|---|---|---|---|---|---|
| 5 | 0.45 | 2.23 | 4.94 | 5.06 | 5.61 |
| 10 | 1.56 | 3.34 | 5.64 | 5.74 | 5.82 |
| 15 | 2.11 | 4.19 | 5.78 | 5.84 | 5.82 |
| 20 | 2.75 | 4.89 | 5.82 | 5.90 | 5.82 |
| 25 | 3.25 | 5.28 | 5.84 | 5.92 | 5.84 |
| 30 | 3.50 | 5.47 | 5.84 | 5.92 | 5.84 |
| 40 | 3.87 | 5.64 | 5.85 | 5.92 | 5.85 |
| 50 | 4.17 | 5.75 | 5.85 | 5.92 | 5.85 |
| 60 | 4.29 | 5.78 | 5.87 | 5.92 | 5.85 |
| 70 | 4.45 | 5.86 | 5.87 | 5.92 | 5.85 |
| 80 | 4.54 | 5.91 | 5.87 | 5.92 | 5.85 |
| 90 | 4.70 | 5.91 | 5.87 | 5.92 | 5.95 |

TABLE 4b

| Time (min) | Delivery of powder (grams) High heat 1 hole | 3 holes | 6 holes | 10 holes | 20 holes |
|---|---|---|---|---|---|
| 5 | 0.33 | 1.86 | 4.35 | 5.04 | 5.63 |
| 10 | 0.62 | 2.51 | 5.22 | 5.78 | 5.79 |
| 15 | 0.88 | 2.90 | 5.66 | 5.86 | 5.83 |
| 20 | 0.98 | 3.06 | 5.73 | 5.86 | 5.83 |
| 25 | 1.04 | 3.33 | 5.77 | 5.87 | 5.86 |
| 30 | 1.12 | 3.58 | 5.77 | 5.89 | 5.86 |
| 40 | 1.22 | 4.18 | 5.85 | 5.89 | 5.91 |
| 50 | 1.49 | 4.50 | 5.85 | 5.89 | 5.95 |
| 60 | 1.60 | 4.72 | 5.85 | 5.89 | 5.95 |

Comparison with Example 2 shows considerably improved delivery of the powder.

EXAMPLE 5

In this Example devices as described above with reference to FIG. 3 of the accompanying drawings were used. Each device, of height 8.3 cm, was provided with twenty-two vent holes of diameter 1 cm. Delivery of the powders of Batches A and B through six dispensing holes at the low heat setting was compared. The results are shown in Table 5. The presence of vent holes in the side of the cup appears to increase the powder delivery rate slightly in the initial stages with both batches of powder.

TABLE 5

| Time (min) | Delivery of Powder (grams) Batch A without vent holes | Batch A with vent holes | Batch B without vent holes | Batch B with vent holes |
|---|---|---|---|---|
| 5 | 2.90 | 3.00 | 2.92 | 3.37 |
| 10 | 4.13 | 4.40 | 4.36 | 4.74 |
| 15 | 4.83 | 4.89 | 5.20 | 5.27 |
| 20 | 5.18 | 5.17 | 5.64 | 5.50 |
| 25 | 5.35 | 5.31 | 5.84 | 5.58 |
| 30 | 5.44 | 5.41 | 5.93 | 5.70 |
| 40 | 5.50 | 5.52 | 5.98 | 5.77 |
| 50 | 5.69 | 5.58 | 6.00 | 5.83 |
| 60 | 5.69 | 5.69 | 6.00 | 5.86 |
| 70 | 5.72 | 5.76 | 6.00 | 5.88 |
| 80 | 5.74 | 5.79 | 6.00 | 5.89 |

TABLE 5-continued

| Time (min) | Delivery of Powder (grams) Batch A without vent holes | Batch A with vent holes | Batch B without vent holes | Batch B with vent holes |
|---|---|---|---|---|
| 90 | 5.77 | 5.79 | 6.00 | 5.89 |

EXAMPLE 6

In an experiment similar to that described in Example 1, using the powder of Batch B with the dryer on its low heat setting, a number of pieces of black acrylic fabric were included in the fabric load. 3 devices were tested, two having wall heights of 4.0 cm and 8.6 cm as already described in connection with FIGS. 1 and 2. The third device had a wall height of 1 cm, i.e. the peripheral wall did not extend above the level of the delivery surface and the device therefore resembled a frustoconical disc. After each drying operation the occurrence of visible powder residues on the black fabric was assessed.

While in all cases the incidence of visible powder residues was low, the lowest incidence of all occurred with the large cup device, whereas the disc shaped device produced the highest incidence of visible powder.

Since the size of the residual patches is substantially greater than that of individual particles, the occurrence of residual patches is indicative of powder agglomeration on the fabric surface. Clearly the incidence of powder agglomeration is lower with the cup shaped devices than with the disc shaped alternative, and this in turn attests to the more even powder distribution from the cup.

We claim:

1. A device for conditioning fabrics in a laundry dryer, which device comprises a fabric conditioning agent in freely flowing powder form in a container having a plurality of apertures through which the powdered fabric conditioning agent can pass under laundry dryer operating conditions, the container being provided with at least one outwardly projecting region which is effective to prevent or reduce direct contact between the said apertures and the fabrics, the projecting region including means to permit nesting with a second identical device in such a manner that the second device will close the said apertures.

2. A device as claimed in claim 1, which is of generally tapered configuration, having a base free of apertures, a peripheral wall extending upwardly from said base, an upper surface of larger area than the base and provided with apertures, the peripheral wall extending upwardly beyond the upper surface to an extent sufficient to allow a second identical device to be stacked together with the first device with its base superjacent the apertured upper surface of the first device whereby the base of the second device closes the apertures of the first device, the peripheral wall being free of apertures at or below the level of the apertured upper surface.

3. A device as claimed in claim 2, which is of generally frustoconical configuration, having a circular base, a curved peripheral wall and a circular upper surface.

4. A device as claimed in claim 2, whereby the region of the peripheral wall that extends upwardly beyond the upper surface is provided with apertures.

5. A device as claimed in claim 2, wherein the circular upper surface has at least six apertures having a diameter of at least 2 mm.

* * * * *